US005679172A

United States Patent [19]

Pritt

[11] Patent Number: 5,679,172

[45] Date of Patent: Oct. 21, 1997

[54] SURFACE DECONTAMINATION

[75] Inventor: Andrew Pritt, Workington, United Kingdom

[73] Assignee: British Nuclear Fuels plc, Cheshire, United Kingdom

[21] Appl. No.: 399,983

[22] Filed: Mar. 7, 1995

[30] Foreign Application Priority Data

Mar. 9, 1994 [GB] United Kingdom ..... 9404552

[51] Int. Cl.[6] ..... B08B 7/00; B08B 9/087; B08B 9/38

[52] U.S. Cl. ..... 134/6; 134/8; 134/9; 134/18; 451/354; 451/358

[58] Field of Search ..... 134/6, 8, 9, 18; 451/354, 358

[56] References Cited

FOREIGN PATENT DOCUMENTS 1 559 726 1/1980 United Kingdom .
1559726 1/1980 United Kingdom .

*Primary Examiner*—Zeinab El-Arini
*Attorney, Agent, or Firm*—Nixon & Vanderhye P.C.

[57] ABSTRACT

A decontaminating apparatus for removing a layer of contaminated material, such as radioactively contaminated concrete, includes two material removing devices which are driven, alternately, towards and away from one another. Each material removing device includes two rotatable scabbling drums enclosed in a shroud from which removed material is conveyed to a waste collection skip. The material removing devices are mounted at the free ends of two pivotable arms arranged to be driven in mutually opposite directions by a common drive mechanism. A frame supports the two material removing devices, the frame being connected to an articulated arm which extends from a remotely-operated vehicle. The vehicle is located on a platform which can be raised and lowered to facilitate access by the material removing devices to the entire surface under treatment.

20 Claims, 5 Drawing Sheets

SURFACE DECONTAMINATION

BACKGROUND OF THE INVENTION

1. Field of the Invention

This invention relates to decontaminating surfaces and, in particular, to an apparatus and a method for removing a layer of material, such as concrete, which contains hazardous substances, for example radioactive substances.

2. Discussion of Prior Art

When decommissioning radioactively contaminated concrete structures, such as chimneys or nuclear reactor containment vessels, it is desirable to remove firstly a top layer of the concrete which constitutes the most highly radioactive portion of the structure. Because of the radioactive environment existing within these structures the removal of the concrete layer is carried out by remotely operated equipment.

After removal of the highly active top layer the remainder of the structure can then be dismantled less remotely than would otherwise be the case if the top layer was not removed. Thus, the remaining dismantling tasks can be carried out using simpler and less expensive plant and equipment.

SUMMARY OF THE INVENTION

According to the present invention there is provided a decontaminated apparatus for removing a layer of contaminated material from a surface, the apparatus including a first material removing means, a second material removing means, and drive means for moving the first and second material removing means, wherein to remove said layer of material, the drive means is operable to move the first and second material removing means in a direction away from one another and further operable to move the first and second material removing means in a direction towards one another.

Preferably the drive means is operable to move the first and second material removing means simultaneously in a direction away from one another and to move the first and second material removing means simultaneously in a direction towards one another.

The first material removing means may be mounted at one end of a pivotably mounted first arm and the second material removing means may be mounted at one end of a pivotably mounted second arm.

In a preferred embodiment the drive means comprises a rotatable traverse bar and a nut arrange don the traverse bar and operatively connected to the first and second arms, the traverse bar and nut having corresponding external and internal screw threads which cooperate such that on rotation of the traverse bar in one direction the nut moves along the traverse bar to cause the first and second arms to move away from one another and on rotation of the traverse bar in the opposite direction the nut moves along the traverse bar to cause the first and second arms to move towards one another.

Advantageously, the first and second arms are mounted on a support arranged for movement in a direction normal to the direction of movement of the first and second material removing means and parallel to the surface being decontaminated.

The support may comprise a movable bracket, the bracket being arranged for movement along guide means extending in a direction normal to the direction of movement of the first and second material removing means and parallel to the surface being decontaminated.

Preferably, wheels are provided on the movable bracket, the wheels being adapted to run along the said guide means.

The movable bracket may be operatively connected to an elongate screw extending in a direction normal to the direction of movement of the first and second material removing means and parallel to said surface, whereby rotation of the screw causes movement of the movable bracket along the said guide means.

In a preferred embodiment the support further comprises an inner tube fixedly attached at one end to the movable bracket and an outer tube telescopically arranged around the inner tube, the first and second arms being pivotably mounted on said outer tube, and a spring having one end attached to the inner tube and having the other end attached to the outer tube, whereby the spring acts on said outer tube so as to urge the first and second material removing means against the surface.

Suitably, the first and second material removing means each include at least one rotatable drum having a peripheral surface adapted to remove material from the surface.

Each of the first and second material removing means may include at least one support roller, said support roller serving to bear the reaction load of the associated material removing means.

Preferably, the first and second material removing means each includes a shroud extending over the rotatable drum or drums and the roller or rollers, and waste conveying means extending from the shroud to a waste collection means, whereby material removed from said surface is conveyed by said waste conveying means to said waste collection means.

The decontaminating apparatus may further comprise a frame for supporting the first and second material removing means, the frame being connected to one end of an articulated arm, the other end of which extends from a remotely-operated vehicle.

Preferably, the remotely-operated vehicle is located on a movable platform arranged for movement in a direction normal to the direction of movement of the first and second material removing means.

The material to be removed may comprise radioactively contaminated concrete.

In a preferred embodiment, the surface comprises an internal surface of a cylindrical wall.

According to a further aspect of the invention there is provided a method of removing a layer of contaminated material from a surface, the method comprising the steps of simultaneously moving first and second material removing means in a direction towards one another so that each of said first and second material removing means removes a strip of material, simultaneously moving the first and second material removing means in a direction normal to that in which the first and second material removing means move towards each other, and then simultaneously moving the first and second material removing means in a direction away from one another so that each of the first and second material removing means removes a further strip of material.

Preferably, the first and second material removing means are moved in said direction normal to that in which the first and second material removing means move towards one another by an amount such that the said strip and further strip of material overlap.

BRIEF DESCRIPTION OF THE DRAWINGS

Embodiments of the invention will now be described, by way of example, with reference to the accompanying drawings, in which.

DETAILED DISCUSSION OF THE PREFERRED EMBODIMENTS

Figure 1:
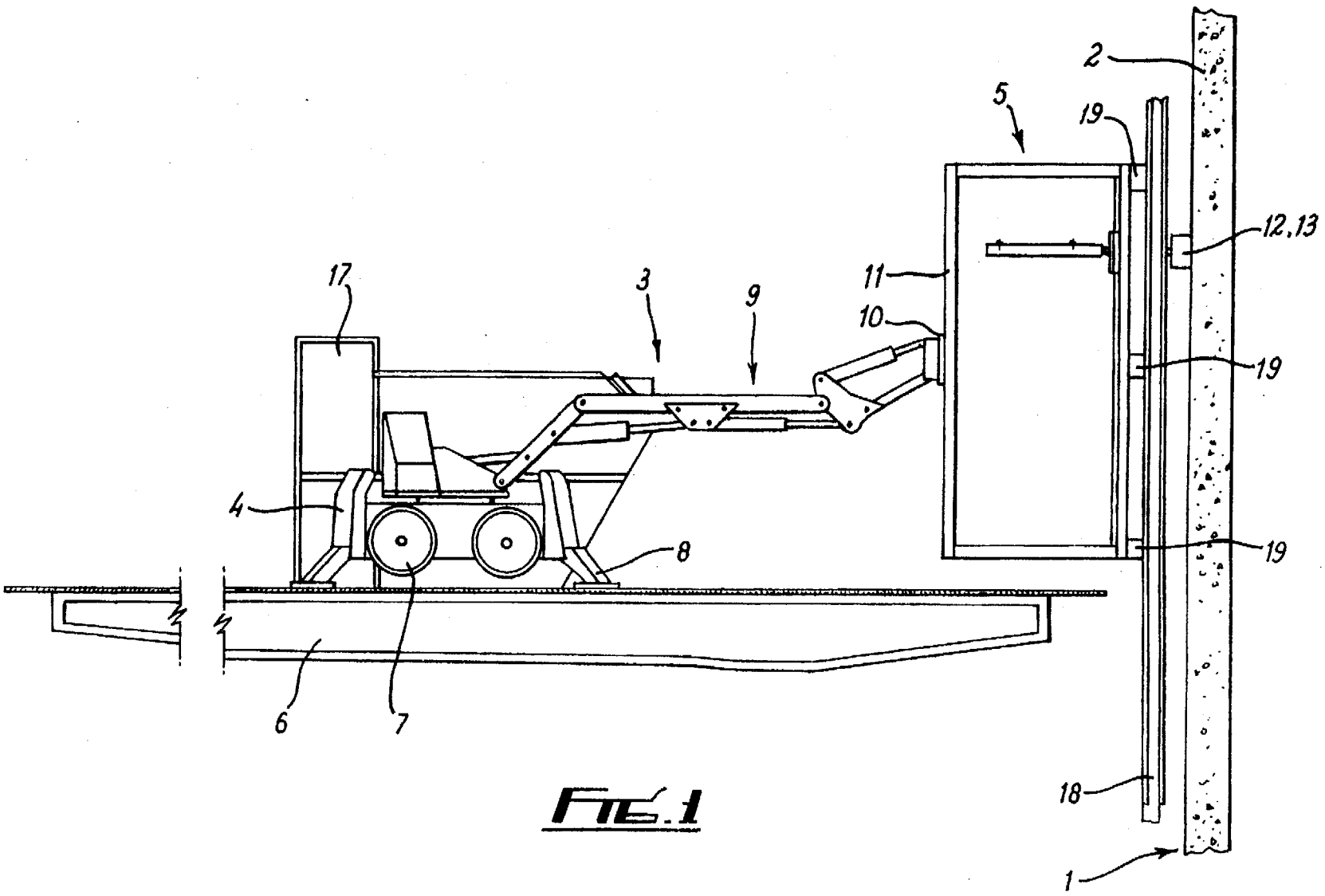
FIG. 1 is a side elevation showing the general arrangement of a decontaminating apparatus for removing a layer of material from a contaminated surface.
Figure 2:
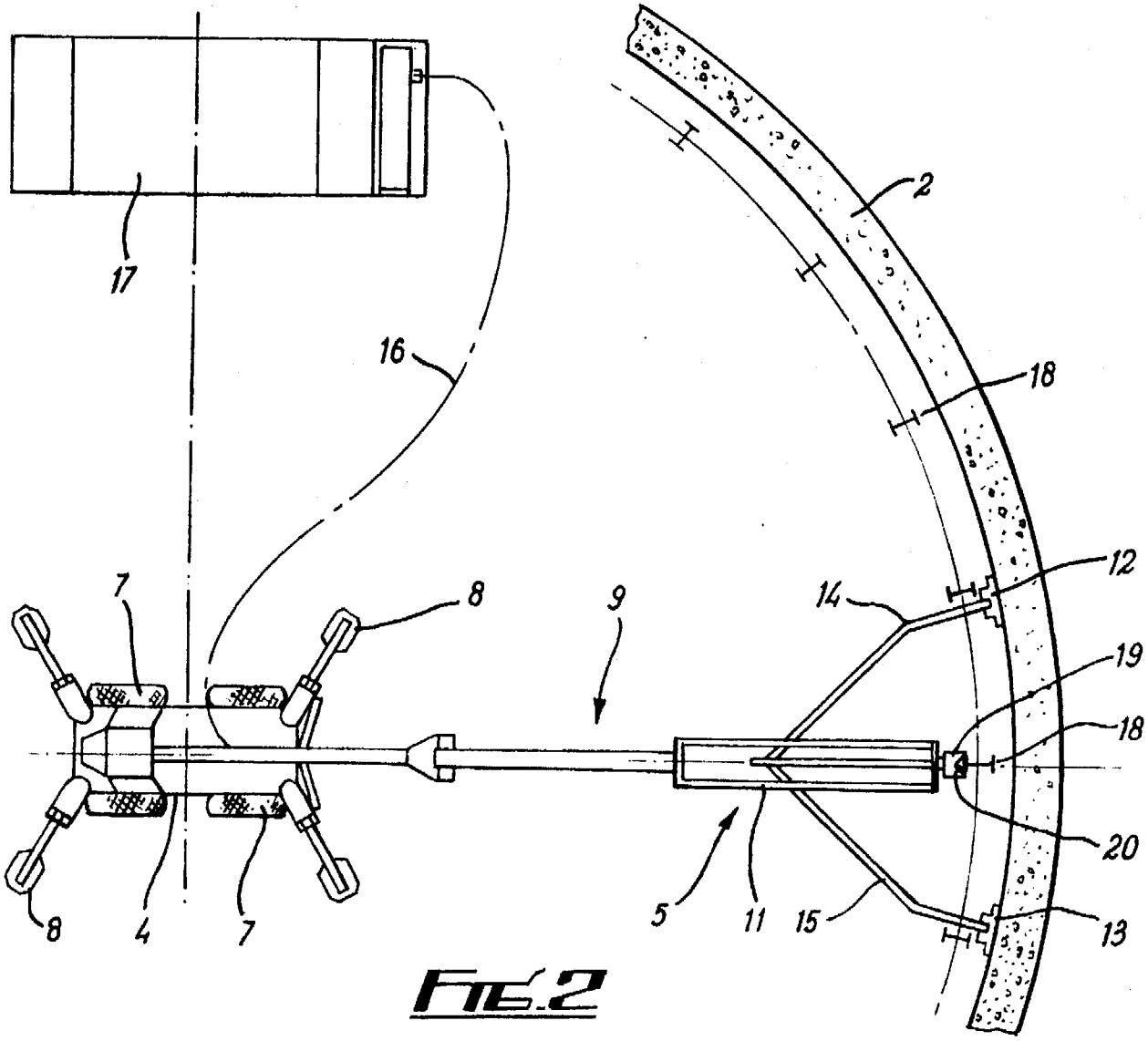
FIG. 2 is a plan view of the decontaminating apparatus shown in FIG. 1.

Referring to FIGS. 1 and 2, a structure 1 to be dismantled, for example, a cylindrical chimney, has a radioactively contaminated concrete wall 2. Prior to complete dismantling, a surface layer of highly active concrete material is removed from an internal surface of the wall 2 using a remotely-controlled decontaminating apparatus 3. The apparatus 3 comprises a remotely-operated vehicle 4 which supports a material removing device, hereinafter referred to as a scabbling device 5, designed to remove a layer of contaminated material from the inner surface of the wall 2.

The decontaminating apparatus 3 is supported on a platform 6 which is movable vertically along the axis of the chimney 1 so that the scabbling device 5 can be presented to different regions of the wall 2. The vehicle 4 is equipped with four wheels 7, enabling it to be moved by remote control to the desired location on the platform 6. When in position, four legs 8 are extended from the vehicle 4 on to the platform 6 so as to support the vehicle in a fixed position. Extending forwardly from the vehicle 4 is an articulated arm 9 having one end connected to a mounting plate 10 of a frame 11 which forms part of the scabbling device 5.

The scabbling device 5 includes two shrouded scabbling heads 12, 13 each of which is mounted, respectively, on the end of a cranked pivotal arm 14, 15. The arms are driven, in a manner hereinafter described, so that the scabbling heads 12, 13 move towards and away from one another while removing strips of concrete from the inner surface of the wall 2. Suction hoses, not shown, are connected to the scabbling heads 12, 13 to convey waste material removed from the wall to a suction hose 16 which leads to a waste collection skip 17 arranged on the platform 6. The air stream required for conveying the waste material through the suction hoses is derived from a vacuum created within the waste collection skip 17. Filters are provided in the skip 17 for removing waste material from the conveying airstream.

Fixed to the inner surface of the chimney 1 are a number of equally-spaced stanchions 18 which have been used during the service life of the chimney to support the components of an insulation lining. During an initial stage of the decommissioning procedure, the insulation lining is removed, enabling the stanchions 18 to be utilised for locating the scabbling device 5. For this purpose, the frame 11 is provided with three vertically spaced location blocks 19, each having a V-shaped recess 20 whose sides are urged against the stanchions 18. It will be apparent that with structures not provided with in situ stanchions, other means for locating the scabbling device could readily be devised.

Figure 3:
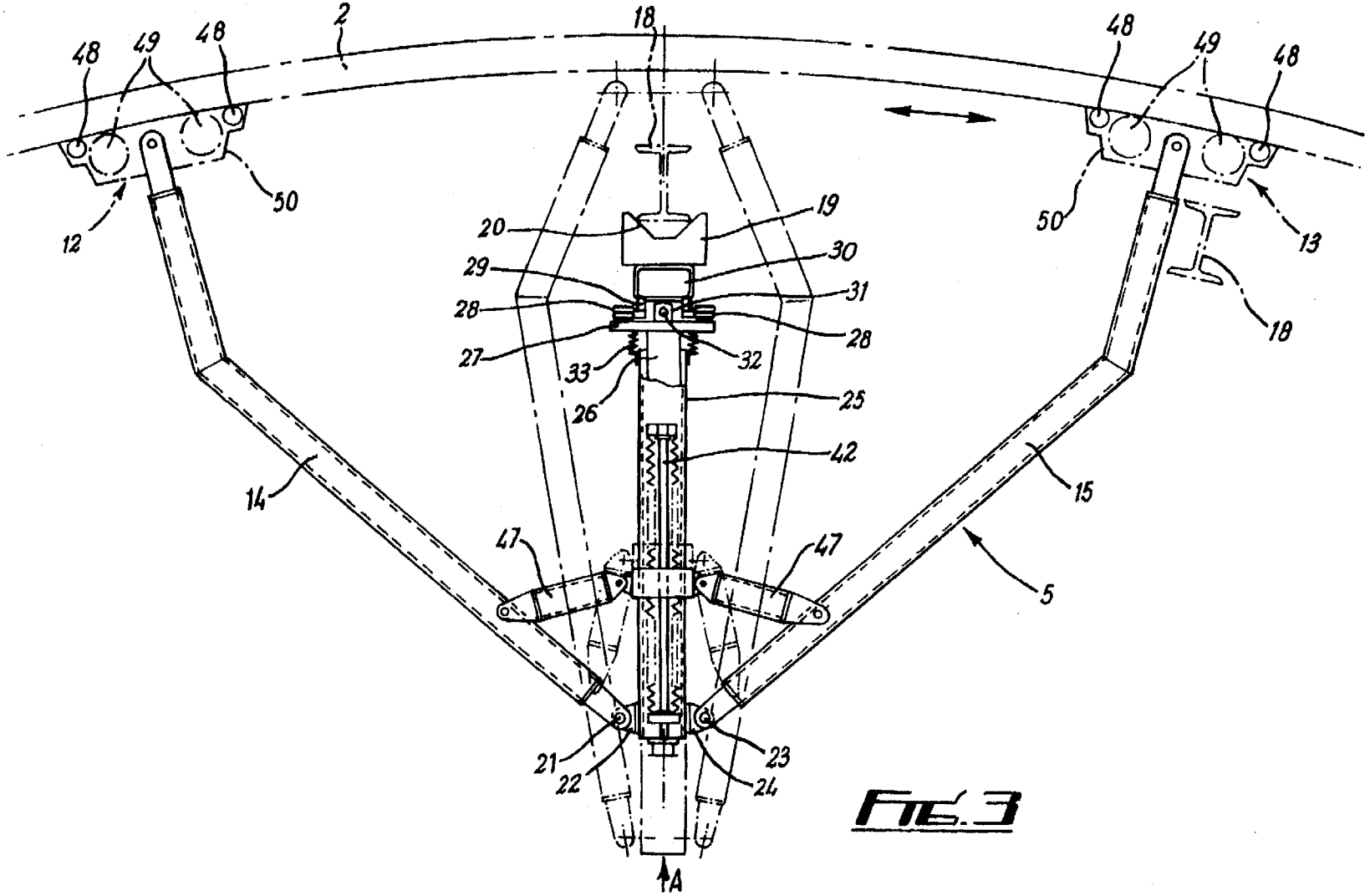
FIG. 3 is a plan view at a larger scale showing the decontaminating device forming part of the apparatus shown in FIGS. 1 and 2.
Figure 4:
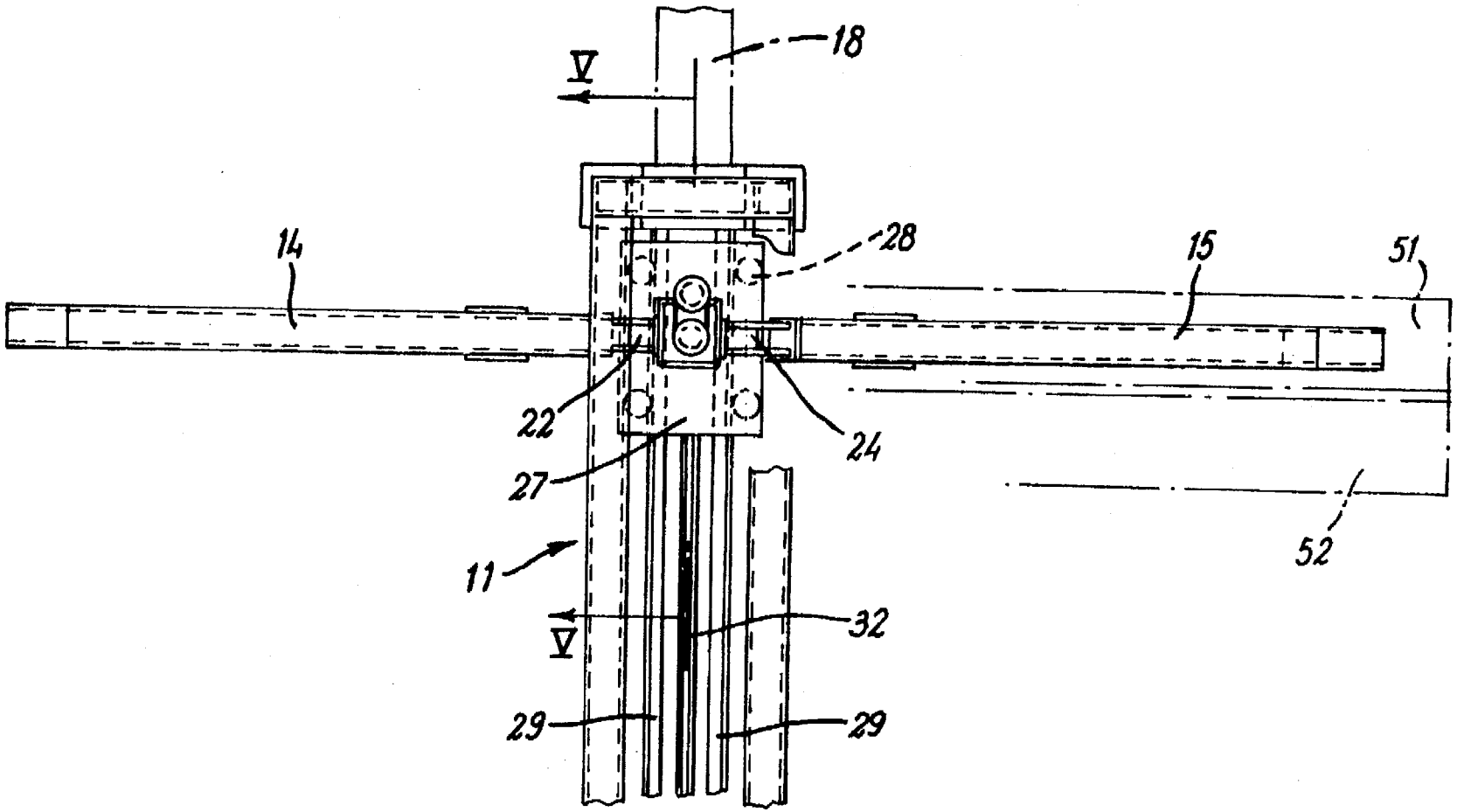
FIG. 4 is an end elevation viewed in the direction of arrow A shown in FIG. 3.
Figure 5:
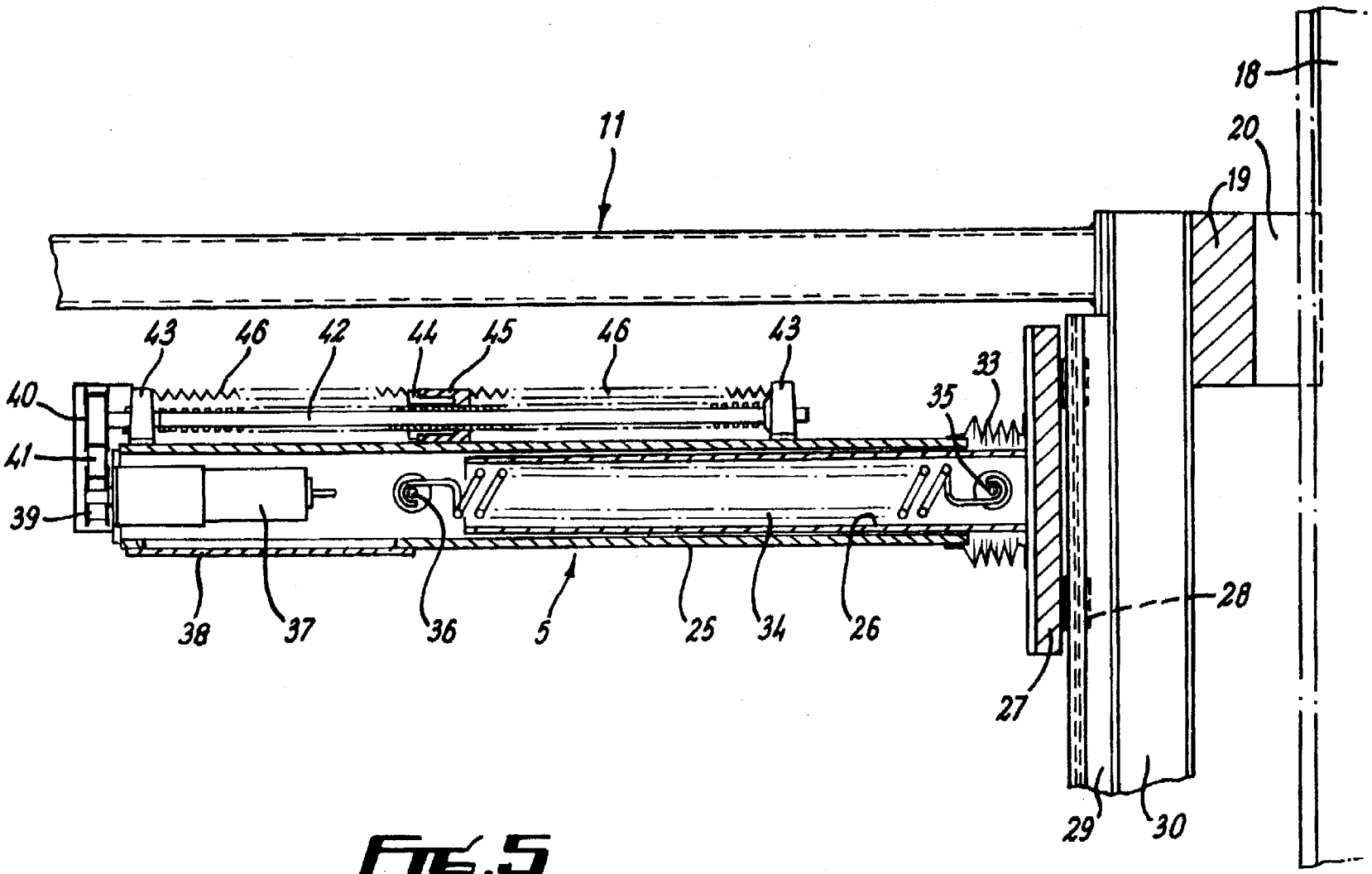
FIG. 5 is a cross-sectional side elevation on the line V—V shown in FIG. 4.

Referring to FIGS. 3 and 4, the arm 14 supporting the scabbling head 12 is pivotably mounted on a pivot pin 21 held in mounting bracket 22. Similarly, the arm 15 supporting the scabbling head 13 is pivotably mounted on a pivot pin 23 held in a mounting bracket 24. Both of the mounting brackets 22, 24 are fixed to the outer end of an outer support tube 25. As best seen in FIG. 5, the outer support tube 25 is telescopically arranged around an inner support tube 26. The inner end of the inner support tube 26 is welded to a movable slide bracket 27 having four wheels 28 which are arranged to run along two vertical guideways 29. The guideways 29 are fixed to a vertical hollow tube 30 of rectangular cross-section and forming part of the frame 11. Welded to the tube 30 are the three location blocks 19. A rearwardly projecting boss 31 (see FIG. 3) is provided on the rear surface of the slide bracket 27. A screw-threaded hole in the boss 31 receives a correspondingly threaded screw 32 which extends parallel to the frame 30 between the two guideways 29. Rotation of the screw 32 so as to move the slide bracket 27 along the guideways 29 is derived from an electrical motor (not shown). A protective gaiter 33 extends between the end of the outer tube 25 and the slide bracket 27.

The two scabbling heads 12, 13 are urged against the surface of the wall 2 by a helical spring 34 arranged within the inner support tube 26. One end of the helical spring 34 is hooked around a dowel 35 fixed to the inner support tube 26 and the other end of the spring is hooked around a dowel 36 fixed to the outer support tube 25. The force exerted by the helical spring 34 tends to pull the outer support tube 25 towards the slide bracket 27, thereby urging the scabbling heads 12, 13 against the surface of the wall 2.

Movement of the scabbling heads 12, 13 towards and away from one another is derived from a drive unit 37, which comprises a motor and gearbox assembly mounted at the outer end of the outer support tube 25. Mounted on the output shaft of the drive unit 37 is a drive pulley 39 which imparts a drive to a driven pulley 40 by means of a driving belt 41. The driven pulley 40 is mounted on the end of a traverse bar 42 having an external screw thread formed along its length. Each end of the traverse bar 42 is supported by a bearing 43. The traverse bar 42 passes through a correspondingly internally threaded ball nut 44 which is secured to a saddle 45. The saddle 45 is of hollow section so as to surround the outer support tube 25 which serves as a guide for the saddle. Protective gaiters 46 extend from each end of the saddle 45 to a respective bearing 43 so as to surround the traverse bar 42. A link 47, pivotably mounted at each end, connects the arm 14 to the saddle 45 and, similarly, a link 48, pivotably mounted at each end, connects the arm 15 to the saddle 45.

The scabbling heads 12, 13 are pivotably connected to the free end of a respective arm 14, 15. Each head is provided with a pair of load-bearing rollers 48 which enable the head to run along the surface of the wall 2 while bearing the reaction forces set up during operation. Also, each scabbling head 12, 13 is equipped with a pair of rotatable electrically-driven scabbling drums 49, each having a peripheral surface provided with tungsten carbide tips which cut a layer of concrete from the wall as the heads move along the wall surface. To minimise the scattering and dispersion of dust and debris the scabbling heads 12, 13 are provided with shrouds 50. Connected to each of the shrouds 50 is a flexible suction hose, not shown, which conveys the removed material to the suction hose 16 which then conduits the material to the waste collection skip 17.

The decontaminating apparatus operates in the following manner. With the articulated arm 9 connected to the mounting plate 10 of the scabbling device frame 11, the vehicle 4 is moved on the wheels 7 into the desired position on the platform 6 by remote control. When in position, the articulated arm 9 is operated so that the locating blocks 19 are pressed against a stanchion 18. The scabbling heads 12, 13 are urged by the helical spring 34 (see FIG. 5) so that the wheels 48 press against the inner surface of the wall 2 and thereby bear the reaction loads. The vehicle legs 8 are then extended on to the surface of the platform 6 so as to support the vehicle 4 in a fixed position.

With the scabbling heads 12, 13 held by the arms 14, 15 at their outermost positions, is when they are furthest apart as seen in FIG. 3, the scabbling drums 49 are set in rotation. The drive unit 37 is switched on so that the traverse bar 42 is caused to rotate through the drive pulley 39, driving belt 41 and driven pulley 40. Rotation of the traverse bar 42 causes movement of the ball nut 44 and the saddle 45 along the traverse bar 42 in a direction towards the stanchion 18. Movement of the saddle 45 is transmitted to the arms 14, 15 through the links 47, 48. Thus, the arms 14, 15 pivot on their respective pivot pins 21, 23 so that the scabbling heads 12, 13 move inwards along horizontal paths towards one another. During this movement the rotating scabbling drums 49 cut into the wall 2 to remove a strip 51 (see FIG. 4) of concrete from the surface. Typically, the strip 51 may have a width of 200 mm and a depth of 5 mm. Material removed by the scabbling drums 49 is sucked from the shrouds 50 through the flexible hoses connected thereto, not shown, and then through the suction hose 16 (see FIG. 2) to the waste collection skip 17.

When the arms 14, 15 and scabbling heads 12, 13 reach their innermost position, as indicated in chain-dot lines in FIG. 3, the drive unit 37 is stopped. Operation of the screw 32 is then commenced so that the slide bracket 27 runs on the wheels 28 down the two vertical guideways 29. The consequent downwards movement of the outer support tube 25 and the arms 14, 15 causes the scabbling heads 12, 13 to move in a vertical direction normal to the direction in which they move when cutting the horizontal strip 51. When a lower cutting position is reached, the rotation of the screw 32 is terminated. In this position the upper surfaces of the scabbling drums 49 lie above, typically by 20 mm, the lower limit of the removed strips 51.

The drive unit 37 is then operated so as to rotate the traverse bar 42 in the opposite direction. This causes movement of the ball nut 44 and the saddle 45 along the bar 42 in an outwards direction towards the driven pulley 40. Thus, the arms 14, 15 are pivoted on their respective pivot pins 21, 23 so as to move the scabbling heads 12, 13 away from one another in a horizontal direction. A further horizontal strip 52, the upper limit of which overlaps the lower limit of the previously cut strip 51, is therefore removed by the rotating scabbling drums 49. When the arms 14, 15 reach their outermost limits, the scabbling heads 12, 13 are again indexed vertically to a further lower cutting position. The scabbling heads 12, 13 are then brought together while removing a further strip of concrete, again overlapping the previously cut strip, from the wall 2. This procedure is repeated until a rectangular area is removed, the area being defined by the limits of travel of the scabbling heads 12, 13 in the horizontal and vertical directions. Microswitches, not shown, are preferably provided to initiate the operation of the traverse bar 42 and the screw 32 so as to obtain the required changes in the direction of movement of the two scabbling heads 12, 13. The platform 6, together with the decontaminating apparatus 3, is then lowered and the procedure described above is repeated until a further rectangular area is removed.

When the lowermost rectangle of concrete has been removed from the wall 2, the platform 6 can then be raised to an elevated position at the top of the chimney 1. In this position the decontaminating apparatus 3 is manoeuvred until the frame 11 is positioned so that the locating blocks 19 can be urged against a further stanchion 18 located next but one to that previously used.

Thus, by manoeuvring the scabbling device 5 by means of the vehicle 4 and the articulated arm 9, and by raising and lowering the platform 6 a layer of contaminated material can be removed from the entire inner surface of the chimney wall 2. After removal of the contaminated layer, the remainder of the wall can then be dismantled.

If desired, the scabbling heads 12, 13 can be arranged to move in offset horizontal paths, thereby allowing the two heads to overlap as they come together. This provides the apparatus with improved surface coverage.

Although the invention has been described as applied to the decontamination of a chimney having a circular cross-section, it will be appreciated that it can also be used for decontaminating planar surfaces, such as floors or ceilings of buildings.

I claim:

1. A decontaminating apparatus for removing only a layer of contaminated material from a surface without removing a remainder of the surface, said apparatus comprising:

a first material removing means, a second material removing means, and drive means for moving the first and second material removing means, wherein to remove said layer of contaminated material the drive means is operable to move the first and second material removing means alternately in directions towards and away from one another while said first and second removing means are in contact with said surface.

2. A decontaminating apparatus according to claim 1, wherein the drive means is operable to move the first and second material removing means alternately in the direction away from one another and to move the first and second material removing means in a direction towards one another.

3. A decontaminating apparatus according to claim 1, wherein the first material removing means is mounted at one end of a pivotably mounted first arm and the second material removing means is mounted at one end of a pivotably mounted second arm.

4. A decontaminating apparatus according to claim 3, wherein the drive means comprises a rotatable traverse bar and a nut arranged on the traverse bar and operatively connected to the first and second arms, the traverse bar and nut having corresponding external and internal screw threads which cooperate such that on rotation of the traverse bar in one direction the nut moves along the traverse bar to cause the first and second arms to move away from one another and on rotation of the traverse bar in the opposite direction the nut moves along the traverse bar to cause the first and second arms to move towards one another.

5. A decontaminating apparatus according to claim 3, wherein the first and second arms are mounted on a support arranged for movement in a direction normal to the direction of movement of the first and second material removing means and parallel to the surface being decontaminated.

6. A decontaminating apparatus according to claim 5, wherein the support comprises a movable bracket, the bracket being arranged for movement along guide means extending in a direction normal to the direction of movement of the first and second material removing means and parallel to the surface being decontaminated.

7. A decontaminating apparatus according to claim 6, wherein wheels are provided on the movable bracket, the wheels being adapted to run along said guide means.

8. A decontaminating apparatus according to claim 7, wherein the support further comprises an inner tube fixedly attached at one end to the movable bracket and an outer tube telescopically arranged around the inner tube, the first and second arms being pivotably mounted on said outer tube, and a spring having one end attached to the inner tube and having the other end attached to the outer tube, whereby the spring acts on said outer tube so as to urge the first and second material removing means against the surface.

9. A decontaminating apparatus according to claim 6, wherein the movable bracket is operatively connected to an elongate screw extending in a direction normal to the direction of movement of the first and second material removal means and extending parallel to said surface, whereby rotation of the screw causes movement of the movable bracket along said guide means.

10. A decontaminating apparatus according to claim 1 in which the first and second material removing means each includes at least one rotatable drum having a peripheral surface adapted to remove contaminated material from the surface being decontaminated.

11. A decontaminating apparatus according to claim 10, wherein each of the first and second material removing means includes at least one support roller, said support roller serving to bear any reaction load of the respective material removing means.

12. A decontaminating apparatus according to claim 11, wherein the first and second material removing means each includes a shroud extending over the rotatable drum or drums and the roller or rollers, the apparatus further comprising waste conveying means extending from the shroud to a waste collection means, whereby contaminated material removed from said surface is conveyed by said waste conveying means to said waste collection means.

13. A decontaminating apparatus according to claim 1, wherein the apparatus further comprises a frame for supporting the first and second material removing means, the frame being connected to one end of an articulated arm, the other end of which extends from a remotely-operated vehicle.

14. A decontaminating apparatus according to claim 13, wherein the remotely operated vehicle is located on a platform arranged for movement in a direction normal to the direction of movement of the first and second material removing means.

15. A decontaminating apparatus according to claim 1, wherein the contaminated material to be removed comprises radioactively contaminated concrete.

16. A decontaminating apparatus according to claim 1, wherein the surface comprises an internal surface of a cylindrical wall.

17. A method of removing a layer of contaminated material from a surface without removing a remainder of the surface, the method comprising the steps of:

alternately moving first and second material removing means towards and away from one another so that each of said first and second material removing means removes a strip of contaminated material from said surface during each movement, additionally moving the first and second material removing means, during said moving step, in a direction normal to a direction in which the first and second material removing means move towards each other.

18. A method according to claim 17, wherein the first and second material removing means are moved in said normal direction by an amount such that said strip overlaps with a subsequent strip.

19. A decontaminating apparatus for removing a layer of contaminated material from a surface of a contaminated structure, said apparatus comprising:

a remotely operated vehicle located on a platform arranged for movement relative to said surface, a frame supporting first and second material removing means, an articulated arm being connected at one end to said vehicle and at the other end to said frame, drive means for moving the first and second material removing means, wherein to remove said layer of contaminated material, the drive means is operable to move the first and second material removing means alternately in directions towards and a way from one another while in contact with said surface.

20. A decontaminating apparatus for removing only a layer of contaminated material from a surface without removing a remainder of the surface, said apparatus comprising:

a first scabbling head, a second scabbling head, and a pair of cranked pivotal arms for moving the first and second scabbling heads, wherein, to remove said layer of contaminated material, the arms are operable to move the first and second scabbling heads alternately in directions towards and away from one another while said first and second scabbling heads are in contact with said surface.

* * * * *